US006615847B1

(12) United States Patent
Hagelstam

(10) Patent No.: US 6,615,847 B1
(45) Date of Patent: Sep. 9, 2003

(54) DECREASING AMPLITUDE HAIR-WAVING APPARATUS AND METHOD

(75) Inventor: Peter Hagelstam, Stockholm (SE)

(73) Assignee: Volumaster AB (SE)

( * ) Notice: Subject to any disclaimer, the term of this patent is extended or adjusted under 35 U.S.C. 154(b) by 0 days.

(21) Appl. No.: 09/743,372

(22) PCT Filed: Jul. 5, 1999

(86) PCT No.: PCT/SE99/01221

§ 371 (c)(1),
(2), (4) Date: Mar. 9, 2001

(87) PCT Pub. No.: WO00/02465

PCT Pub. Date: Jan. 20, 2000

(30) Foreign Application Priority Data

Jul. 9, 1998 (SE) ..... 9802484

(51) Int. Cl.[7] ..... A45D 1/00
(52) U.S. Cl. ..... 132/225; 132/210
(58) Field of Search ..... 132/223, 224, 132/225, 226, 227, 229, 230, 231, 232, 233, 234, 235, 236, 263, 268, 269, 217, 243, 244, 210; D28/35, 37

(56) References Cited

U.S. PATENT DOCUMENTS

| | | | | |
|---|---|---|---|---|
| 1,095,392 A | * | 5/1914 | Frey | 132/232 |
| 1,465,838 A | | 8/1923 | Caneavri | |
| 1,662,330 A | * | 3/1928 | Privitera | 132/118 |
| 2,155,282 A | * | 4/1939 | Schoenling | 132/225 |
| 3,680,565 A | * | 8/1972 | Giles et al. | 132/224 |
| 4,739,151 A | | 4/1988 | Smal | |
| 5,294,777 A | | 3/1994 | Denhup | |
| 5,357,988 A | | 10/1994 | Nakamura | |
| 6,223,753 B1 | * | 5/2001 | Lo | 132/224 |

FOREIGN PATENT DOCUMENTS

| | | |
|---|---|---|
| DE | 3606718 | 4/1987 |
| DE | 3709273 | 9/1988 |
| EP | 0224970 | 6/1987 |
| GB | 74 | 1/1863 |

* cited by examiner

*Primary Examiner*—Eduardo C. Robert
*Assistant Examiner*—David C Comstock
(74) *Attorney, Agent, or Firm*—Dann, Dorfman, Herrell and Skillman, P.C.

(57) ABSTRACT

A device for producing waves and body in hair comprising curling tongs having heatable leg elements. The heatable leg elements have a wave shape with decreasing amplitude. The amplitude decreases from a maximum at the scalp-contacting end of the heatable leg elements to substantially no amplitude at the other end of the heatable leg elements. Heat-reducing lips may extend from the scalp-contacting end of the device. In one embodiment, the heatable leg elements are arcuate and can pivot about an axis extending along each leg, respectively. A method of using the device to form waves and body in hair wherein the amplitude of the wave is greatest near the scalp and decreases along the length of the hair in the direction toward its tip.

35 Claims, 4 Drawing Sheets

DECREASING AMPLITUDE HAIR-WAVING APPARATUS AND METHOD

TECHNICAL FIELD

The present invention relates to a device, and to curling tongs having such a device, for creating volume in hair, especially in straight or wavy hair, without, in so doing, changing other visual aspects of the hair. For example, gentle waves present in the hair will still be visible as such after treatment.

PRIOR ART

With known techniques it is possible to perm the hair roots in order to lift the hair so that it does not fall so flat around the head. A problem with this known method is that the permed portion grows out and thus remains in the hair, but at the wrong place. In addition, it is a relatively complicated and costly procedure and is difficult to do at home.

Devices similar to the one according to the invention are known by terms such as crimping tongs or crimping irons. However, a feature of these known devices is that they curl the hair in such strong wave patterns that the latter are completely noticeable. The hair does indeed acquire greater volume when these are used, but its appearance is not otherwise maintained. The hair becomes tightly curled. EP 0 224 970 describes an example of such a device which is intended to be used to curl the hair or flatten it out by means of the hair being pinched firmly between either two grooved or wave-shaped heated plates or two flat heated plates. If the grooved plates are used, the hair is curled and is thus given greater volume, but its natural wave is lost.

U.S. Pat. No. 5,294,777 describes a device for creating lift and volume in hair. This is achieved here by means of a portion of the hair, nearest the head, being pinched firmly between heated plates so that it becomes straight and perpendicular to the head. It is not made clear here how long this effect lasts. The device also consists of a grip which has to be heated up in a stand before use.

DE-A1 3,606,718 concerns two wave-shaped legs between which the hair is pinched firmly during treatment with perm liquids. The treatment entails a wave pattern in the form of curls being formed in the hair. The wave-shaped legs are placed on the head such that the amplitude of the wave pattern increases in the direction from the head towards the tip of the hair.

SUMMARY

The invention has the object of making available a device for creating volume in hair, without the hair losing its natural wave.

Another object of the invention is to make available a device for creating volume in hair which is inexpensive and easy to use and whose effect remains until the next time the hair becomes wet, for example when the hair is washed.

These and other objects are achieved by means of the device according to the present invention, which comprises first and second heatable leg elements which are each provided with a surface for giving off heat to the hair and thereby shaping the hair, which leg elements are provided with a wave shape which extends with decreasing amplitude across the surfaces. These objects are also achieved with curling tongs which comprise first and second legs which are connected to each other via a hinge, which curling tongs are provided with the said device so that the first leg element is arranged on the first leg and the second leg element is arranged on the second leg.

The invention thus affords a device, and curling tongs having such a device, for creating volume in the hair by means of the fact that a portion of the hair nearest the head is pinched between heated leg elements so that this portion is given a curl or wave which is sufficient to lift the hair. The appearance of the hair is not otherwise affected. The effect lasts until the hair becomes wet and it can be done easily at home without the help of a hairdresser.

BRIEF DESCRIPTION OF THE FIGURES

The invention will be explained in greater detail below with reference to the attached drawings which show various embodiments.

DETAILED DESCRIPTION OF EMBODIMENTS

Figure 1:
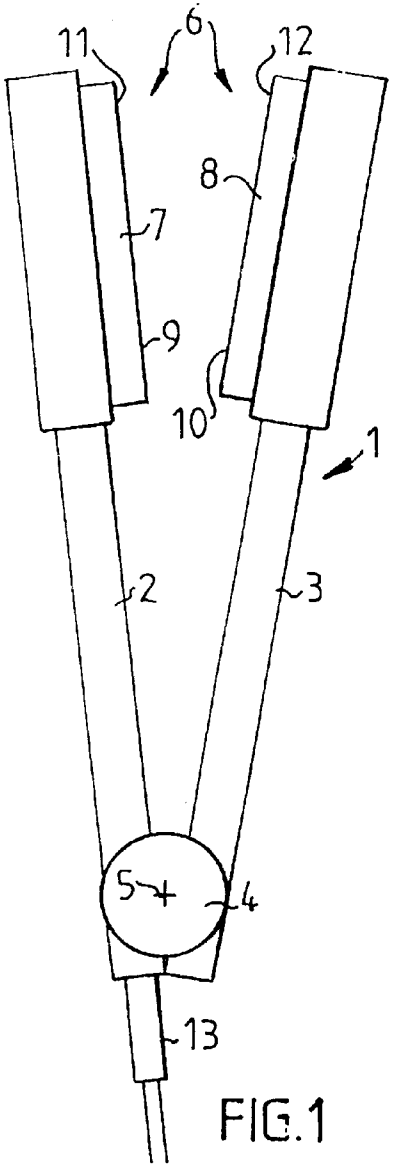
FIG. 1 shows curling tongs according to a first embodiment of the invention.
Figure 8:
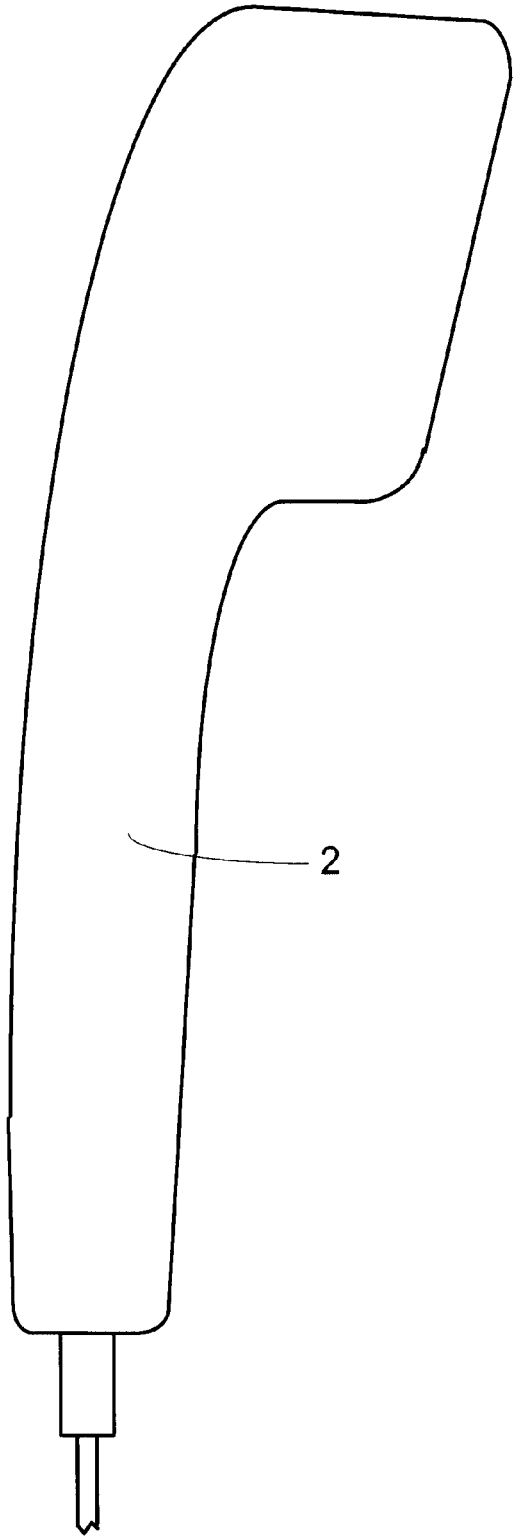
FIG. 8 shows a fourth embodiment of a device and curling tongs according to the invention.

FIG. 1 shows a side view of curling tongs 1 according to the invention, comprising first and second legs 2, 3 which are joined at a hinge 4 so that the legs 2, 3 can pivot about an axis 5 in the hinge 4. The curling tongs 1 are provided with a device 6 according to the invention. The device 6 comprises first and second heatable leg elements 7, 8. The first leg element 7 is arranged on the first leg 2 and dthe second leg element 8 is arranged on the second leg 3. On the surfaces 9, 10 of the leg elements 7, 8 facing each other, there is a wave shape 11, 12 which will be described in more detail below. A connection 13 is provided for electric current with which the leg elements 7, 8 can be heated. This heating can continue during the actual use of the curling tongs 1. The heating is also preferably controlled by a thermostat. When the leg elements 7, 8 of the curling tongs 1 are brought together, the wave shapes 11, 12 fit into each other. The legs 2, 3 and leg elements 7, 8 can consist of two separate parts which are joined by a suitable securing means which will be explained below. The legs 2, 3 and leg elements 7, 8 can alternatively be designed in one and the same piece. The curling tongs 1 can also be provided with a spring (not shown) which acts with an opening force on the legs 2, 3 of the curling tongs 1. The leg elements 7, 8 and also the legs 2, 3 can be curved in their longitudinal direction in order thereby to follow the shape of the head, as shown in FIG. 8.

Figure 3:
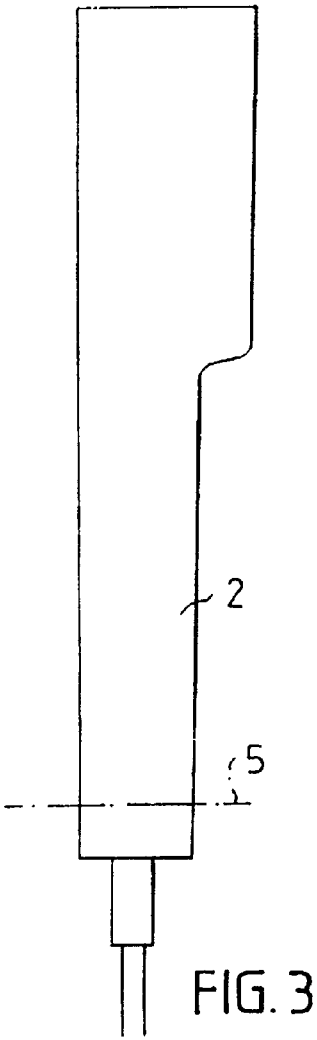
FIG. 3 shows the leg in FIG. 2, seen from the outside of the curling tongs.
Figure 2:
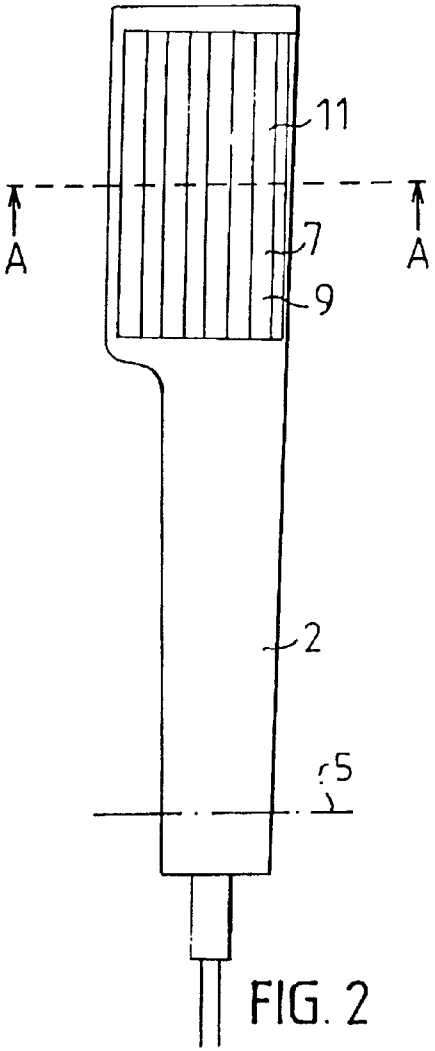
FIG. 2 shows a leg seen from the centre of the curling tongs according to FIG. 1.

FIG. 2 shows the first leg 2 seen from the side which aces the second leg 3. It will be seen from FIG. 2 that the waves 11 extend in a direction essentially parallel to the axis 5 of the hinge 4, about which axis 5 the legs 2, 3 can pivot. FIG. 3, shows the first leg 2 seen from the side which faces away from the second leg 3.

Figure 4:
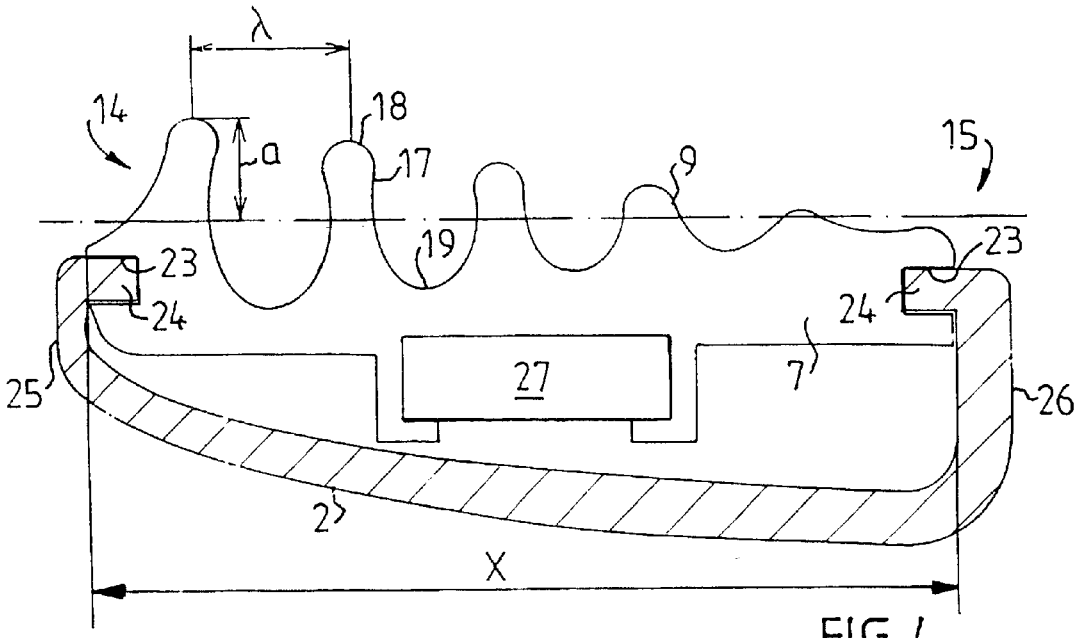
FIG. 4 shows a section A—A through the leg in FIG. 2.

FIG. 4 shows a section along the line A—A in FIG. 2 according to a preferred embodiment of the invention. The leg element 7 is provided with a wave shape 11 which extends with decreasing amplitude (a) across the surface 9. Each leg element 7, 8 comprises first and second end edges 14, 15. The wave shape 11 has its greatest amplitude at the first end edge 14 and essentially no amplitude at the second end edge 15. The distance x between the first and second end edges 14, 15 lies in the range of 20–80 mm, preferably 30–60 mm. The amplitude (a) of the wave 11 with reatest amplitude (a) lies in the range of 1–10 mm, preferably 2–7 mm. The distance between two wave peaks 18, i.e. the wave length λ, lies in the range of 3–15 mm, preferably 5–10 mm. It is possible for the wave length λ to vary along the surfaces 9, 10 of the leg elements 7, 8.

According to the embodiment shown in FIG. 4, the leg element 7 is provided, at the first and second end edges 14, 15, with grooves 23 which extend along each respective end edge 14, 15. The legs 2, 3 of the curling tongs 1 are provided with flanges 24 which extend into the grooves 23 of the leg elements 7, 8. The leg elements 7, 8 are fixed on the legs 2, 3 by means of the grooves 23 and flanges 24. The legs 2, 3 preferably extend beyond the end edges 14, 15 of the leg elements 7, 8, for which reason the width of the legs 2, 3 is greater than the distance x. This means that first and second end areas 25, 26 are formed in the legs 2, 3. The first end area 25 of the legs 2, 3 thus comes to meet the first end edge 14 of the leg elements 7, 8. The legs 2, 3 are preferably made of a heat-insulating material such as plastic, which means that when the first end edge 14 of the respective leg element 7, 8 is placed near the head, the first end area 25 of the respective leg 2, 3 will ensure that no discomfort in the form of high temperature will be experienced by the person being reated with the curling tongs 1. The legs 2, 3 can be designed in such a way that the leg elements 7, 8 can be released from the legs 2, 3 in a simple manoeuvre. The leg elements 7, 8 can thus be replaced with other leg elements 7, 8 having different dimensions.

FIG. 4 also shows how a heat-generating element 27 is arranged on the leg element 7. A heat-generating element 27 is preferably arranged on both the first and second leg elements 7, 8. The heat-generating element 27 can be designed as a resistor which is fed with electricity.

The device according to the preferred embodiment is intended to be used on that portion of the hair which is nearest the head. When the leg elements 7, 8 are heated, the device 6 is held to the head and a tuft of hair is pinched together between the heated leg elements 7, 8. The leg elements 7, 8 must reach nearest the head so that only the innermost portion of each strand of hair is treated. That part of the leg elements 7, 8 where the waves 11, 12 have their greatest amplitude (a) must be nearest the head. In other words, the first end edge 14 must be placed near the head. When the hair is pressed together between the heated wave-shaped 11, 12 surfaces 9, 10, a wave pattern is formed in the hair nearest the head, which pattern remains when the device and the curling tongs 1 are thereafter removed. The amplitude of the wave pattern will decrease along the length of the hair strand in the direction towards its tip. If this treatment is repeated for all the hair, in the portion nearest the head, the waves or curls in the hair will cause the hair to lift and the hair will be given greater volume than it had before the treatment. The natural appearance of the hair is otherwise largely unaffected, i.e. natural wave and the like remains. The wave 11 with the greatest amplitude on the rirst leg element 7 is designed in such a way, and cooperates in such a way with the wave 11 nearest the first end edge 14 of the second leg element 8, that the hair is guided between the leg elements 7, 8 such that the hair nearest the scalp does not come to slope in relation to the scalp.

The above-described method for creating volume in hair is simple to carry out, making the device 6 and the curling tongs 1 according to the invention suitable for both professional use and for use in the home. Furthermore the effect lasts until the hair becomes wet, after which it is easy to repeat the procedure.

Figure 5:
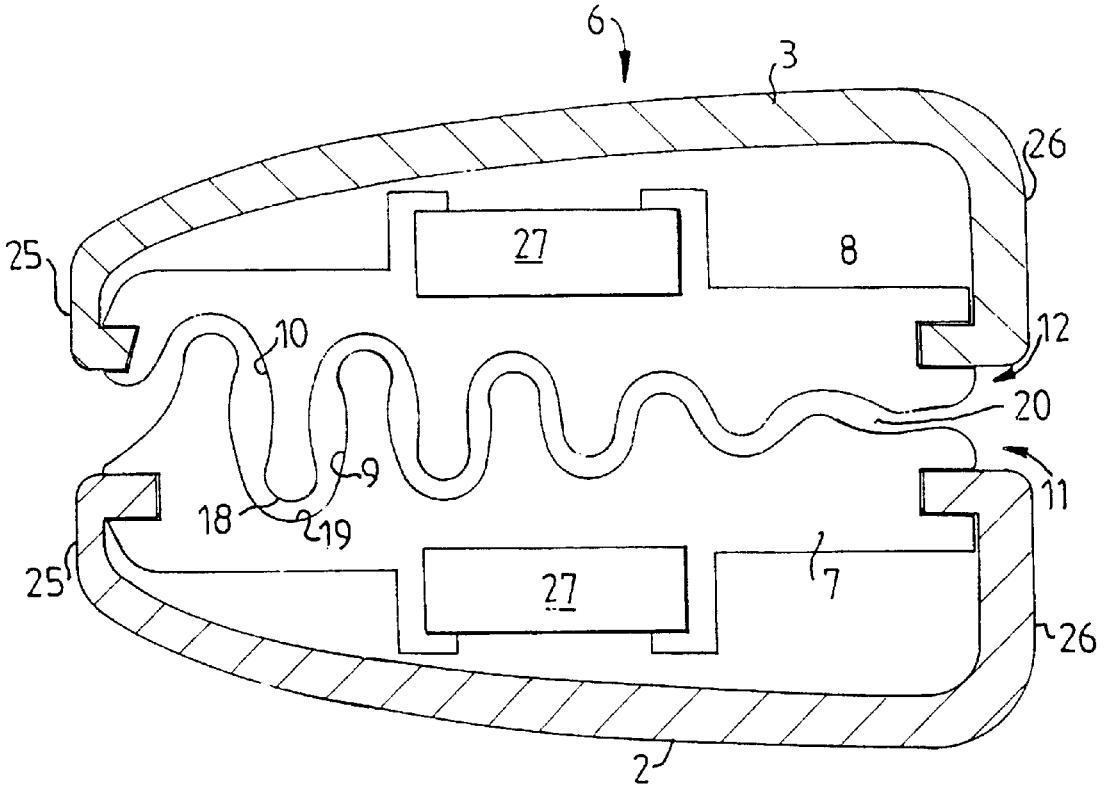
FIG. 5 shows a section, corresponding to that in FIG. 4, of a device according to the first embodiment of the invention.

FIG. 5 shows a section through the device 6 according to the invention when the leg elements 7, 8 are brought together. It will be seen from the figure that the wave shapes 11, 12 of the leg elements 7, 8 essentially complement each other, so that when the surfaces 9, 10 of the leg elements 7, 8 adjoin each other, the wave peaks 18 of the one leg element 7, 8 extend into the wave valleys 19 of the other leg element 7, 8, and vice versa. When the leg elements 7, 8 are arranged on the legs 2, 3 of the curling tongs 1, a gap 20 is preferably formed between the leg elements 7, 8 when the legs 2, 3 of the curling tongs 1 are moved in the direction towards each other. At least that part of the waves 11 with the greatest amplitude (a) comprises inwardly curved surfaces so that a waist 17 is formed at the wave peak 18 in the area between the wave peak 18 and the wave valley 19. The waist 17 allows a play or clearance to form between the surfaces 9, 10 of the leg elements 7, 8, which play or clearance ensures that the pulling force of the hair reduces when the hair is being treated with the device.

Figure 6:
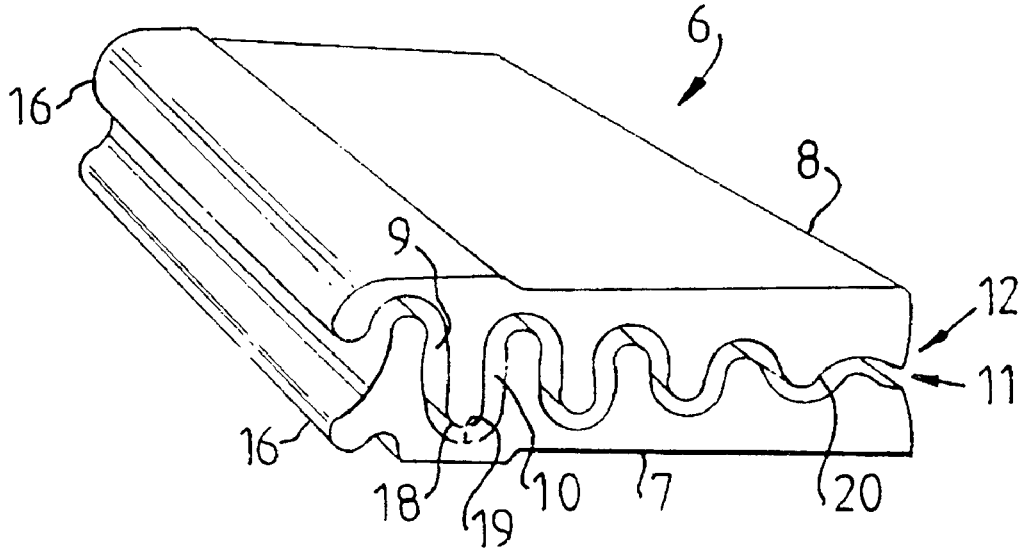
FIG. 6 shows a perspective view of the leg element according to a second embodiment of the invention.

FIG. 6 shows a perspective view of the device 6 according to a second embodiment of the invention. What distinguishes this embodiment from the first embodiment is that a heat-reducing lip 16 is arranged on the first end edge 14 of the second leg element 8. The first end edges 14 of the respective leg element will be placed near the head so that the heat-reducing lips will bear against or be at a short distance from the head. The temperature of the heat-reducing lips 16 is low by comparison with other parts of the leg element 7, 8, which means that no discomfort in the form of high temperature will be experienced by the person being treated with the curling tongs 1.

Figure 7:
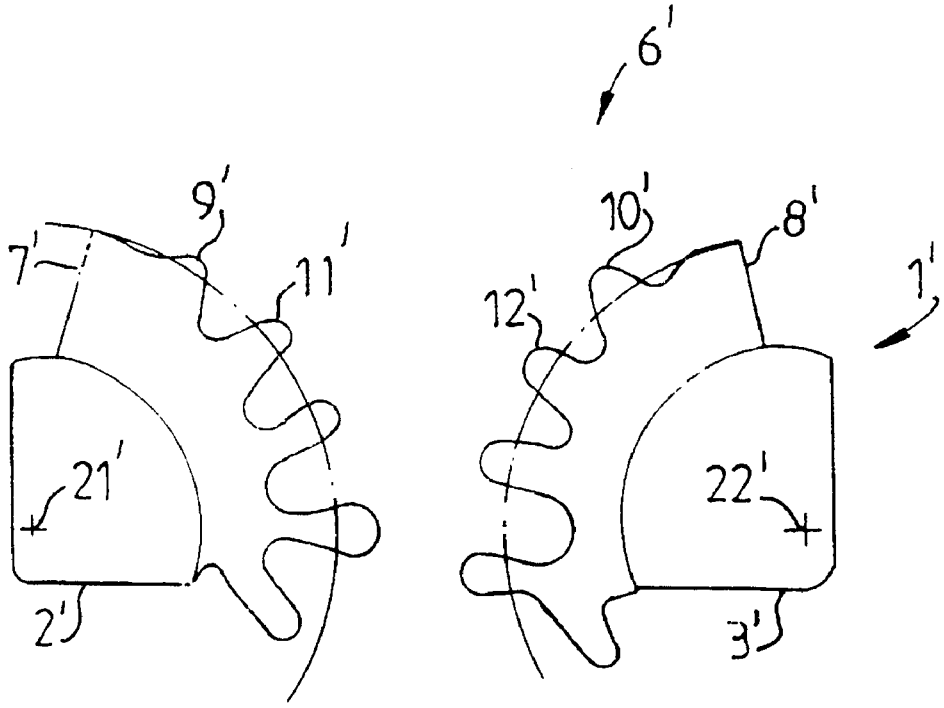
FIG. 7 shows a third embodiment of a device and curling tongs according to the invention.

FIG. 7 shows a device 6' and curling tongs 1' according to a third embodiment of the invention. The surfaces 9', 10' of the leg elements 7', 8' are curved so that when the legs 2', 3' of the curling tongs 1' are brought together, the waves 11', 12' with greatest amplitude (a) of the respective leg elements 7', 8' first engage in each other, after which the remaining waves 11', 12' then engage successively in each other. According to this embodiment, the legs 2', 3' of the curling tongs 1' are connected to each other via a hinge which allows the leg elements 7', 8' or the legs 2', 3' together with the leg elements 7', 8' to be turned about a longitudinal axis 21', 22' which essentially coincides with the longitudinal extent of the legs 2', 3'.

It is conceivable for the leg elements 7, 7'; 8, 8' shown in the first and second embodiments to be combined with each other so that an essentially plane leg element 7, 8 according to the first embodiment can be arranged on one of the legs 2, 2'; 3, 3' of the curling tongs 1, 1' and a curved leg element 7', 8' according to the second embodiment can be arranged on the other legs 2, 2'; 3, 3' of the curling tong 1, 1'.

What is claimed is:

1. A device for shaping hair comprising first and second legs and first and second leg elements attached at corresponding ends of said first and second legs, respectively, each of said first and second leg elements including a heat-generating element and a surface for giving off heat to the hair, wherein (a) the leg elements are provided with a wave shape which extends with decreasing amplitude across the surfaces; (b) the wave shapes of the leg elements essentially complement each other so that when the surfaces of the leg elements adjoin each other, wave peaks of one leg element extend into wave valleys of the other leg element, and vice versa; (c) each leg element comprises first and second end edges, wherein the first end edge is formed to engage with a first end area of the respective first or second leg, which first end area is made of a heat-insulating material; and (d) the wave shape has its greatest amplitude at the first end edge, which engages with the first end area, and substantially no amplitude at the other end edge, for providing a wave pattern in the hair nearest the head such that the amplitude of the wave pattern decreases along the length of the hair in the direction towards its tip.

2. Device according to claim 1 wherein the first end areas and the first end edges are disposed on said device such that they are closest to the scalp of a person whose hair is being shaped.

3. Device according to claim 2 wherein the first end areas extend beyond the first end edges for preventing the leg elements from contacting the scalp of a person whose hair is being shaped.

4. Device according to claim 1, comprising heat-reducing lips formed at the first end edge of the first and second legs.

5. Device according to any of the claims 1–4, wherein at least that part of a wave having a greatest amplitude comprises inwardly curved surfaces, so that a waist is formed at the wave peak, which waist allows a clearance or play to form between the surfaces of the leg elements.

6. Device according to claim 5 wherein the amplitude of the wave with the greatest amplitude is in the range of 1–10 mm.

7. Device according to claim 5 wherein the amplitude of the wave with the greatest amplitude is in the range of 2–7 mm.

8. Device according to claim 5 wherein a distance between two wave peaks is in the range of 3–15 mm.

9. Device according to claim 5 wherein a distance between two wave peaks is in the range of 5–10 mm.

10. Device according to claim 1, wherein the first and second end edges are spaced by a distance in the range of 20–80 mm.

11. Device according to claim 1, wherein the first and second end edges are spaced by a distance in the range of 30–60 mm.

12. A handheld device for shaping hair, comprising:

A. a first leg and a second leg, said first and second legs each having a holding portion and a head portion, said head portion having a toe edge and a heel edge arranged such that when the device is used, the toe edge is directed toward the scalp of a person whose hair is being shaped and the heel edge is directed away therefrom;

B. means for pivotably connecting the holding portions of the first and second legs;

C. a first leg element attached between the toe edge and the heel edge of the head portion of the first leg, said first leg element having a wave-shaped surface extending with decreasing amplitude in a direction from the toe edge to the heel edge;

D. a second leg element attached between the toe edge and the heel edge of the head portion of the second leg, said second leg element having a wave-shaped surface extending with decreasing amplitude in a direction from the toe edge to the heel edge, and a wave shape that is complementary to the wave shape of the wave-shaped surface of the first leg element.

13. The device of claim 12, wherein the first leg element comprises means for heating said first leg element.

14. The device of claim 13, wherein the second leg element comprises a means for heating said second leg element.

15. The device of claim 14, wherein the head portions of the first and second legs each comprise an end area that extends beyond a first end edge of the respective leg elements for preventing the leg elements from contacting the scalp of a person whose hair is being shaped.

16. The device of claim 15 wherein the end areas are formed of a heat insulating material.

17. The device of claim 16 wherein the heat insulating material is a plastic material.

18. The device of any of claims 12–14 or 16–17, wherein each leg element comprises a first end edge and a second end edge, and the first end edge and the second end edge of each leg element are spaced by a distance of 20–80 mm.

19. The device of claim 18, wherein the first end edge and the second end edge of each leg element are spaced by a distance of 30–60 mm.

20. The device of claim 12 wherein the wave-shaped surfaces of the first and second leg elements comprise recessed waist portions that align when the first and second leg elements are closed.

21. The device of claim 12, wherein the wave-shaped surfaces each have a maximum amplitude of 1–10 mm.

22. The device of claim 21, wherein the maximum amplitude is 3–7 mm.

23. The device of claim 12, wherein the wave-shaped surfaces have a wavelength of 3–15 mm.

24. The device of claim 23, wherein the wavelength is 5–10 mm.

25. The device of claim 12, comprising a hinge operatively connected to the holding portions of the first and second legs at respective ends thereof that are distal from the respective head portions.

26. The device of claim 12 wherein the first and second leg elements are arcuate in shape and are pivotally connected to respective head portions of the first and second legs such that the first and second leg elements can rotate about axes that respectively extend along the lengths of the first and second legs, respectively.

27. The device of claim 12, wherein the legs are generally curved and the leg elements extend radially inwardly with respect to the radius of curvature of the legs.

28. The device of claim 12, wherein each of the leg elements comprises a first end edge adjacent the toe edge of the respective head portion and a heat reducing lip extending from said first end edge to beyond the toe edge.

29. A method for creating volume in a person's hair, said method comprising the steps of:

A. providing a hair shaping device having first and second leg elements wherein the first leg element has a wave-shaped surface extending with decreasing amplitude and the second leg element has a wave-shaped surface extending with decreasing amplitude and that is complementary to the wave shape of the wave-shaped surface of the first leg element;

B. heating the first and second leg elements;

C. positioning the heated leg elements over a tuft of a person's hair such that the wave-shaped surfaces of the leg elements having a maximum amplitude extend over portions of the hair strands nearest to the person's scalp;

D. closing the leg elements over the hair tuft; and

E. holding the hair tuft between the leg elements for a time sufficient to impart a wave in the hair that has a maximum amplitude adjacent to the person's scalp and a decreasing amplitude along the length of the hair strands toward the tips thereof.

30. The method set forth in claim 29 comprising the step of providing a hair wave that extends 20 to 80 mm in length.

31. The method set forth in claim 29 comprising the step of providing a hair wave that extends 30 to 60 mm in length.

32. The method set forth in claim 29 comprising the step of providing a maximum amplitude of 1 to 10 mm in the hair wave.

33. The method set forth in claim 29 comprising the step of providing a maximum amplitude of 3 to 7 mm in the hair wave.

34. The method set forth in claim 29 comprising the step of providing a hair wave wherein the distance between wave peaks is 3 to 15 mm.

35. The method set forth in claim 29 comprising the step of providing a hair wave wherein the distance between wave peaks is 5 to 10 mm.

* * * * *